US008438889B2

(12) United States Patent
Eller et al.

(10) Patent No.: US 8,438,889 B2
(45) Date of Patent: May 14, 2013

(54) SHAPED TOP PIN FOR BUMP RESISTANT CYLINDER

(75) Inventors: Darren C Eller, East Lyme, CT (US); Ryan Piantek, Middletown, CT (US); Evaldas Malinauskas, Berlin, CT (US); James Galarneau, Milford, CT (US); David Steele, Middlefield, CT (US); Christopher Hill, New Britain, CT (US)

(73) Assignee: Sargent Maufacturing Company, New Haven, CT (US)

( * ) Notice: Subject to any disclaimer, the term of this patent is extended or adjusted under 35 U.S.C. 154(b) by 1274 days.

(21) Appl. No.: 11/677,621

(22) Filed: Feb. 22, 2007

(65) Prior Publication Data

US 2008/0202180 A1 Aug. 28, 2008

(51) Int. Cl.
*E05B 27/00* (2006.01)
*E05B 15/14* (2006.01)

(52) U.S. Cl.
USPC ..... 70/493; 70/392; 70/421

(58) Field of Classification Search ..... 70/359, 70/392, 416, 418–419, 421, 493
See application file for complete search history.

(56) References Cited

U.S. PATENT DOCUMENTS

| | | | | | |
|---|---|---|---|---|---|
| 1,666,320 | A | * | 4/1928 | Watts | 200/43.07 |
| 2,043,205 | A | | 6/1936 | Thompson | |
| 2,059,129 | A | * | 10/1936 | Maxwell et al. | 70/493 |
| 2,149,733 | A | * | 3/1939 | Hagendorn et. al. | 70/493 |
| 2,202,329 | A | | 5/1940 | Braune | |
| 2,283,489 | A | | 5/1942 | Crousore | |
| 3,587,081 | A | * | 6/1971 | Hawkins et al. | 70/268 |
| 3,762,193 | A | | 10/1973 | Hucknall | |
| 3,837,194 | A | | 9/1974 | Fish | |
| 4,103,526 | A | | 8/1978 | Surko, Jr. | |
| 4,403,486 | A | | 9/1983 | Miyake | |
| 4,631,941 | A | * | 12/1986 | Sjunnesson | 70/493 |
| 4,655,063 | A | * | 4/1987 | Foshee et al. | 70/493 |
| 5,222,383 | A | * | 6/1993 | Fann et al. | 70/493 |
| 5,247,818 | A | * | 9/1993 | Lo | 70/493 |
| 5,893,285 | A | * | 4/1999 | Athanassiou | 70/493 |
| 6,675,617 | B2 | * | 1/2004 | Stemmerik | 70/493 |
| 7,086,259 | B2 | * | 8/2006 | Almoznino | 70/493 |
| 7,100,409 | B2 | * | 9/2006 | Chang | 70/493 |
| 2005/0022568 | A1 | | 2/2005 | Dolev | |

OTHER PUBLICATIONS

Guide to Lock Picking, Theodore T. Tool; Copyright 1991; Chapter 9, Section 9.9.

Opening Locks by Bumping in Five Seconds or Less: Is It Really a Threat to Physical Security?, A Technical Analysis of Bumping, Copyright 2006, Marc Weber Tobias and Investigative Law Offices, Document 060922107, pp. 1-28.

* cited by examiner

*Primary Examiner* — Christopher Boswell
(74) *Attorney, Agent, or Firm* — DeLio & Peterson, LLC

(57) ABSTRACT

The present invention provides a pin and tumbler cylinder lock and a retrofitted cylinder lock which minimizes unauthorized openings of the lock by bumping. The cylinder lock utilizes specially designed driver pins which are correlated in size to the largest possible stack height of the tumbler pins with a bump key inserted in the plug portion of the lock and the shear line height of the lock. All the driver pins are about the same height and preferably symmetrical with a lip on each end. The invention also provides a method for retrofitting existing locks by removing at least one of the driver pins and replacing the removed driver pin or pins with the driver pins of the invention.

11 Claims, 6 Drawing Sheets

SHAPED TOP PIN FOR BUMP RESISTANT CYLINDER

FIELD OF THE INVENTION

The present invention relates to any cylinder locks which employ pins that are linearly displaceable through a shear line, and more particularly, to a method for retrofitting existing locks and to a lock assembly and retrofitted lock assembly for preventing unauthorized manipulation of cylinder locks as employed by burglars using methods based on the physical phenomenon of impact and momentum, such as the Bump or Bumpkey method.

DESCRIPTION OF RELATED ART

In the general type of cylinder lock contemplated by this invention, there is a plurality of tumblers in the form of cylindrical pins, which are mounted in radial bores in a cylindrical barrel or key plug. The lower end of these tumblers project into slots provided in a key. The barrel or key plug is surrounded by a cylinder body which has a number of radial bores corresponding and registered to those bores in the key plug. The interface between the inside of the cylinder body and the outside of the plug defines a shear line. The cylinder body houses a further set of cylindrical pins, which are pressed towards the center by helical springs. The pins in the outer cylinder are termed the drivers or top pins.

When there is no key in the plug, the tumbler and driver bores are in alignment, and the drivers project past the shear line into the tumbler bores in the plug, preventing it from being turned. In order to open the lock, a key is inserted which has its various indentations or slots defining selective recesses and projections which cause each of the tumblers to be held to a definite lifted position such that the dividing line between the driver pins and the tumbler pins in each bore coincides with the shear line between the cylinder and plug. When all pins are appropriately positioned, the plug is free to rotate and the lock can be opened by rotating the plug.

Cylinder locks are vulnerable to many methods of unauthorized manipulation, including the Bump or Bumpkey method. This method employs the well-known physical phenomenon of impact and momentum.

A simple burglary tool, called the Bumpkey, has been developed which uses a key blank. The key blank depressions are all as deep as possible. In this method, a bump tool, which can be a number of devices including a small hammer, head of a large screwdriver, mallet, or "tomahawk," is used to impact the Bumpkey while inserted in the lock. This new development compromises lock security and poses a grave danger to the public and a challenge to the cylinder lock industry.

Every commercial location and every consumer can potentially be the victim of a technique of opening locks known as bumping. If they use conventional pin tumbler cylinders where they live, work, or transact business, then they may be at risk. There are hundreds of millions of existing pin tumbler locks worldwide which are susceptible to bumping and thus this is not an abstract issue.

The critical issue is the ability to obtain a key that fits the target lock. This requires the identification of the manufacturer and keyway so that a proper bumpkey can be produced. If that challenge is met, then virtually all conventional pin tumbler cylinder locks are at risk.

A key that has already been cut to fit any lock will work better than a blank due to depth and spacing issues. The cuts in the key are filed to the deepest depth and using a bumping tool the pins are bumped forcing the driver pins above the shear line and the lock can then be opened.

A "999" or bumpkey can be any key that fits a particular pin tumbler lock and that has been modified so that all of its cuts are to the deepest allowable position, as defined by each manufacturer. The term "fit" means that the key will enter the keyway (the front of the lock), but it will not unlock it. To illustrate, all of the locks in an apartment complex are produced by the same manufacturer and have the same keyway, meaning that the key for apartment 101 can enter the lock of apartment 207 (or any other apartment), but will only unlock apartment 101 for which it was cut. Any key for any apartment in this example could be modified within the complex to be a bumpkey and potentially other complexes where the same or similar manufacturer's locks are utilized.

The "999" term appears to have originated in Denmark about twenty-five years ago, when locksmiths began cutting keys for locks made by one specific manufacturer in their country to the deepest possible code depth of 9 for all positions. By way of background, each assigned depth is given a different "code" number by each vendor, so that their keys can be duplicated by this code without actually requiring the physical key. There are often ten individual coded depths, running from 0-9, where 0 is the shallowest and 9 is the deepest. Thus, the keys came to be known as "999" keys. The term "stack height" means the height of the tumbler pins in the plug as measured from the deepest possible code depth and the height varies by manufacturer. It will be appreciated by those skilled in the art that multiple tumbler pins may be used in each bore but in the embodiment shown for convenience and clarity a single tumbler pin is disposed in each tumbler bore. The term "shear line height" means the height is the radius of the plug. Referring to FIG. 4, the upper lip of the tallest combination of tumbler pin and any master split pins with a bump key inserted will always be below the shear line 18 and tumbler pin 32*e* represents the tallest combination of tumbler pin and any master split pins in the lock. This can also be seen in FIG. 3 where tumbler pin 32*e* is the tallest tumbler pin. This is an important aspect of the present invention that the tallest combination of tumbler pin and any master splits pins with a bump key inserted must be below the shear line at a distance greater than the thickness of the lip of the special driver pin 26*e*.

The term "bumping" refers to the process of forcing the key to interact with the pin tumblers by "bumping" or rapping the key with a bump tool while it is inserted into the lock. This entails hitting the head of the key, causing it to rapidly move forward typically about 0.25 mm. When the key is struck correctly, energy is applied to the base of all the tumbler pins and the energy is imparted to the driver pins bumping the driver pins upward above the shear line and the shear line of the lock is now clear and the plug can be turned to open the lock. Bumping occurs as the result of an inherent design issue within all conventional pin tumbler locks and is based upon a law of physics of impact and momentum where the impacted tumbler pin will remain in place and the driver pins in contact with the tumbler pins will be pushed upward by the impact energy.

Bumping occurs from the exploitation of the placement of two or more pins within each chamber and the ability to briefly separate these pins as they cross the shear line. When the base of a bottom or tumbler pin is struck via the cuts on a key, the top or driver pin is bounced upward. For a few milliseconds, there is a gap between the bottom and top pin. If torque is applied during this brief interval, there is nothing to stop the plug from turning.

SUMMARY OF THE INVENTION

Bearing in mind the problems and deficiencies of the prior art, it is an object of the present invention to provide an improved bump resistant cylinder lock.

It is another object of the present invention to provide an improved bump resistant cylinder lock utilizing driver pins which are specially designed in a shaped pin configuration and correlated in size to the smallest possible distance between bottom pins and the shear line which occurs when the largest possible stack height of the tumbler pins is in the plug with the bump key inserted. This is an important aspect of the invention to minimize or prevent opening of the lock by bumping.

It is another object of the invention to provide a method for retrofitting existing cylinder locks which method can be easily performed by locksmiths or owners of the locks.

It is another object of the invention to provide a retrofitted cylinder lock which is made according to the method of the invention.

Broadly stated, the lock of the present invention is an improved form of cylinder lock wherein the driver pin structure is specially designed cooperatively with the dimensions of the cylinder and plug and tumbler pins to prevent the driver pins from being forced up to and above the shear line when a bumping method is used to try to open the lock.

The above and other objects, which will be apparent to those skilled in the art, are achieved in the present invention which is directed in one aspect of the invention to a pin and tumbler cylinder lock comprising:

a cylinder;

a plug rotationally mounted in the cylinder and having a key slot and forming a shear line between the inner surface of the cylinder and outer surface of the plug, the cylinder, and plug having a plurality of registering radial pin receiving bores;

spring pressed top driver pins mounted in the cylinder bores, each of the driver pins being about the same height or different heights and preferably symmetrical for manufacturing ease, but can also be non-symmetric; and tumbler pins mounted in the registered plug bores;

wherein each of the top driver pins has a smaller diameter intermediate section forming at least a lower lip having an inner surface and an outer surface where the outer surface of each top driver pin lip is in contact with the upper surface of the registered tumbler pin and the inner surface of each top driver pin lip is below the shear line.

In a further aspect of this invention, the radial pin receiving bores may be any combination of radial and non-radial bores or all non-radial bores.

In another aspect of the invention the top driver pins are symmetrical with each end having a lip comprising an outer surface and an inner surface so that the pin can be placed in the cylinder bore with either end facing downward toward the plug bore.

In a further aspect of the invention the thickness of the lip of the top driver pin is equal to or less than the shear line height minus the tallest tumbler pin stack height of the lock.

In another aspect of the invention a method is provided to retrofit an existing tumbler and cylinder lock to enhance their resistance to bumping comprising the steps:

providing a pin and tumbler cylinder lock comprising:

a cylinder;

a plug rotationally mounted in the cylinder and having a key slot and forming a shear line between the inner surface of the cylinder and outer surface of the plug, the cylinder, and plug having a plurality of registering radial pin receiving bores;

spring pressed top driver pins mounted in the cylinder bores; and tumbler pins mounted in the registered plug bores;

removing at least one of the driver pins in the existing locks; and replacing at least one and preferably all the driver pins removed with the driver pins of the invention so that the inner surface of each replaced top driver pin lower lip is below the shear line.

In a further aspect of the invention a retrofitted pin and tumbler lock made by the method of the invention is provided.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figure 1:
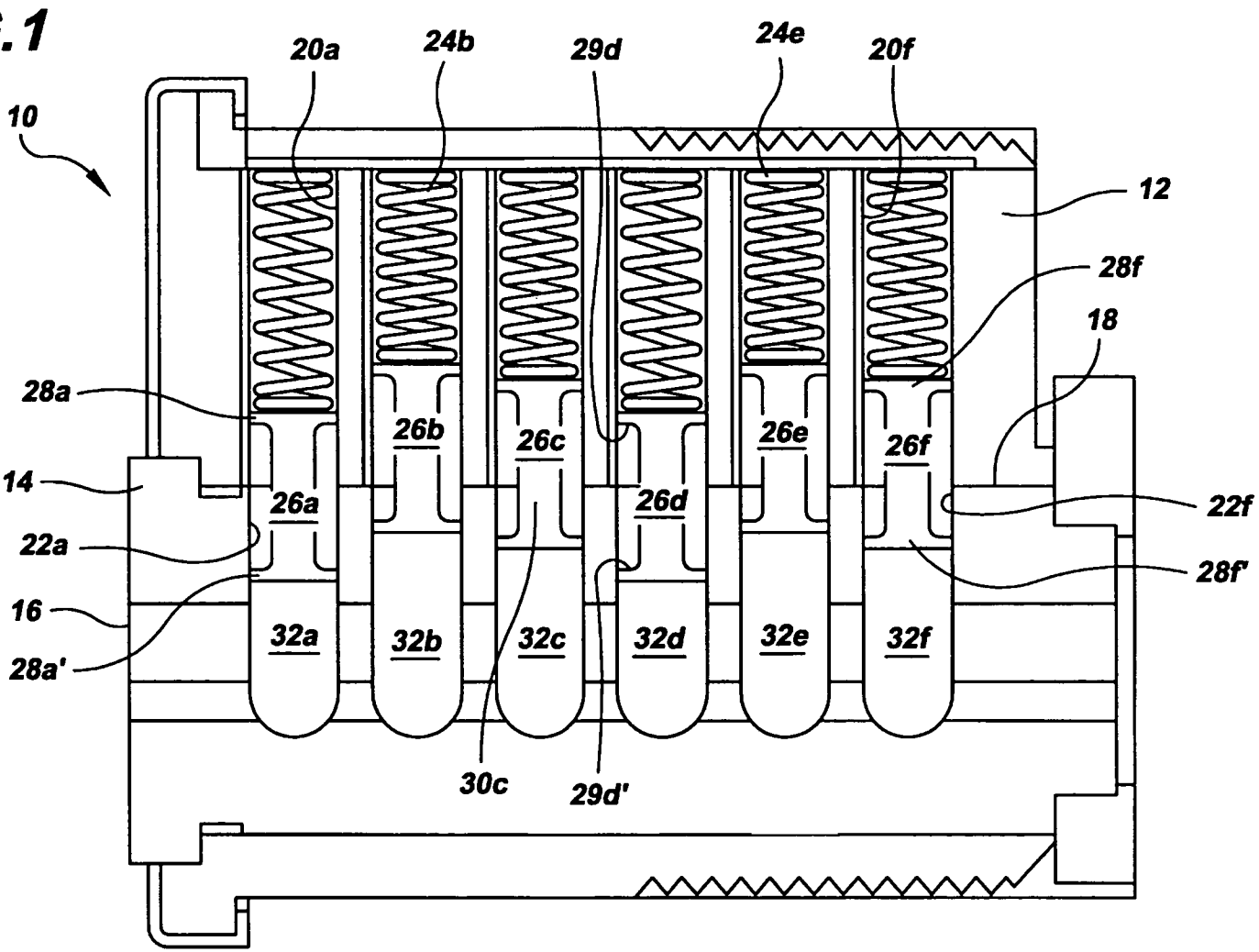
FIG. 1 is a cross-sectional side view of a cylinder lock embodying the features of the present invention.

Referring now to FIG. 1 a conventional tumbler and pin cylinder lock is shown generally as numeral 10. The cylinder lock 10 includes a cylinder portion 12 and a plug portion 14 adapted for rotation therein. The cylinder portion 12 contains a plurality of axially displaced radially disposed bores 20*a*-20*f*. The plug portion includes a similar plurality of bores which are aligned and registered with the cylinder bores when the lock is in its closed or rest position. These plug bores are illustrated as 22*a*-22*f* and each pair of associated bores in the cylinder and plug establishes the radial chamber within which the pin assemblies operate. A key slot 16 is provided in the plug 14.

Each corresponding cylinder bore 20*a*-20*f* and corresponding plug bores 22*a*-22*f* have disposed therein driver pins 26*a*-26*f* and corresponding tumbler pins 32*a*-32*f*. It will be appreciated by those skilled in the art that multiple tumbler pins may be used in each bore but in the embodiment shown for convenience and clarity a single tumbler pin is disposed in each tumbler bore. Also, the lock is shown as having six tumblers and six drivers although any number of tumblers and driver pins may be used as is well known in the art. Typically, five or six tumbler pins and corresponding driver pins are used in the conventional lock.

Each driver pin has associated therewith a cylinder helical spring 24*a*-24*f* which spring presses the driver pin against the tumbler pin.

A shear line 18 is established between the cylinder 12 and the plug 14. The purpose of the shear line will be more further discussed hereinbelow but as can be seen from FIG. 1, the driver pins 26*a*-26*f* intercept the shear line 18 so that the plug 14 cannot be turned.

Also shown in FIG. 1 is that the driver pins 26*a*-26*f* are all about the same height and are symmetrical with a lip 28*a*-28*f* and 28*a*'-28*f*'. Each driver pin has a narrow shank portion 30*a*-30*f*. Thus, for driver pin 26*c*, the driver pin has an upper lip 28*c*, a corresponding bottom lip 28*c*' and a shank portion 30*c*. As shown for driver pin 28*d*, each lip has an inner surface 29*d* and 29*d*'. The thickness of the lip is an important feature of the invention as will be discussed more fully hereinbelow.

Figure 2:
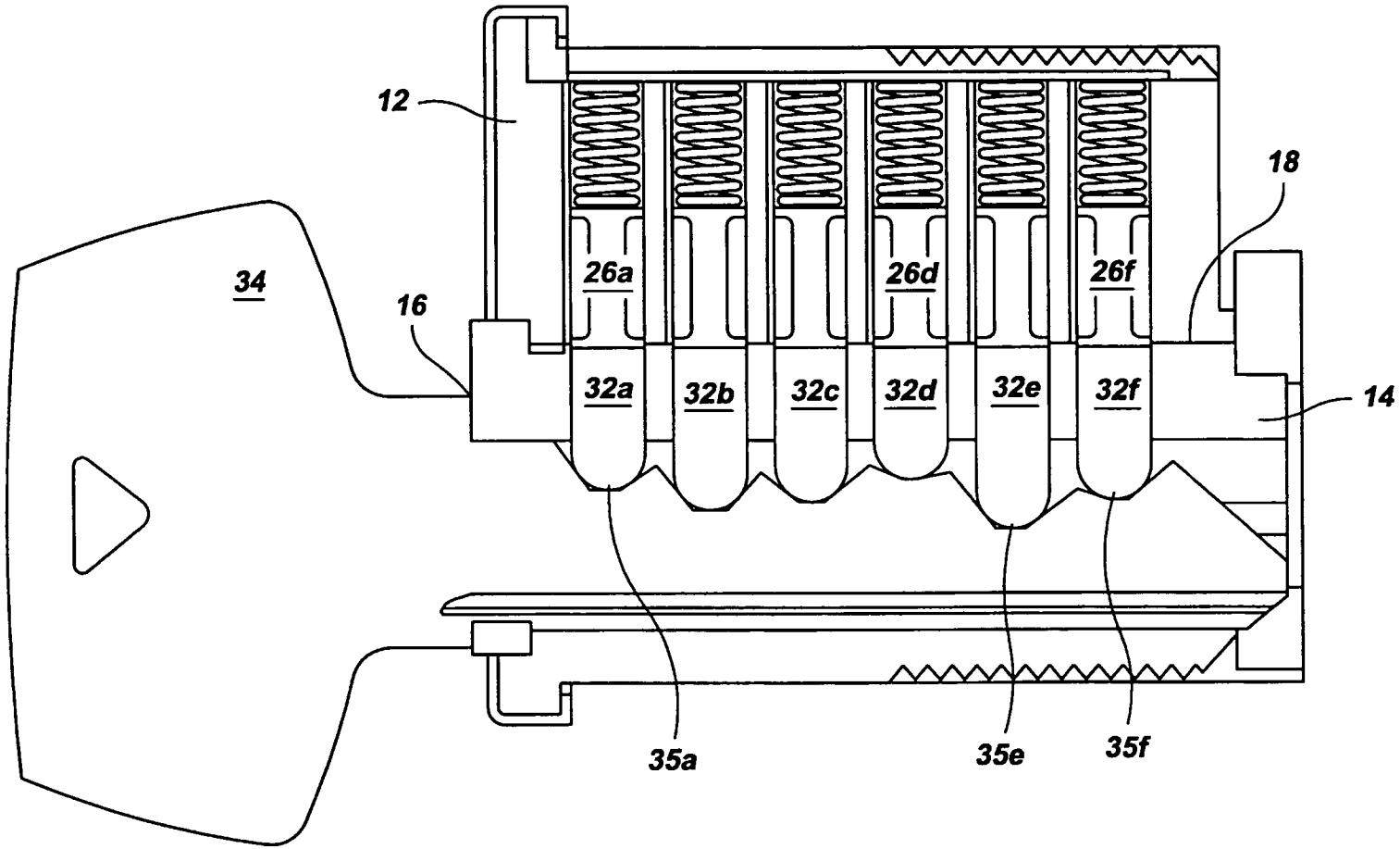
FIG. 2 is the same as FIG. 1 except that a key cut properly to open the lock has been inserted into the lock and the lock can now be opened because the tumbler pins and driver pins are both at the shear line.

Referring now to FIG. 2, the lock of FIG. 1 is shown with a key 34 inserted in the key slot 16. This key was specially designed to open the lock and contains cuts or recesses 35*a*-35*f* which cooperate with the height of the tumbler pins 32*a*-32*f* so that when the key is inserted the height of the tumbler pins mate with the shear line 18. The corresponding driver pins 26*a*-26*f* are pushed upward by the tumbler pins so that they likewise are at the shear line so that the lock, as shown in FIG. 2, may now be opened by rotating the key which rotates the plug 14.

Figure 3:
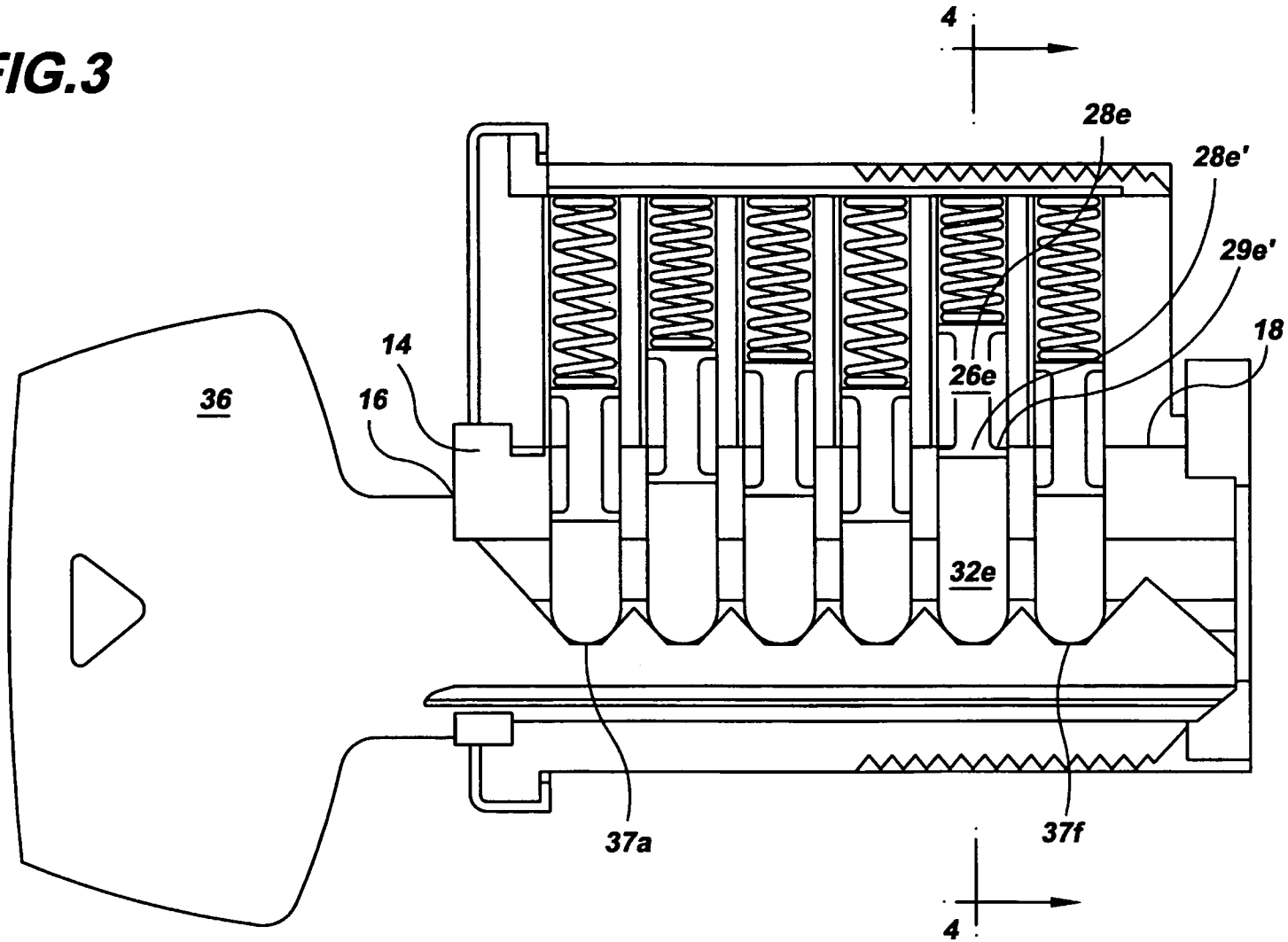
FIG. 3 is the same as FIG. 1 except that a Bumpkey has been inserted into the lock for the purpose of exerting a force on the Bumpkey to bump the driver pins across the shear line to enable opening of the lock.

The lock of the invention may be seen in FIG. 3 which is the same lock as FIGS. 1 and 2 except that a Bumpkey 36 has now been inserted into the key slot 16. As described above, the Bumpkey grooves 37*a*-37*f* have been cut to the lowest depth to facilitate the bumping operation. Thus, when a force is applied to the Bumpkey 36 in the direction of the arrow, impact energy will be provided to each of the tumbler pins 32*a*-32*f* and the corresponding driver pins 26*a*-26*f* would typically be forced upward momentarily across the shear line 18. This will enable the plug 14 to be turned opening the lock.

The lock of the invention as demonstrated by FIG. 3 prevents bumping. Thus, it will be noted that at rest all the driver pins 26*a*-26*f* extend across the shear line 18 preventing rotation of the plug 14 and opening of the lock. It is an important feature of the invention that the inner surface of the lower lip of each driver pin be below the shear line 18 and this is demonstrated by driver pin 26*e*. Driver pin 26*e* is shown as having a lip 28*e*' and an inner surface of the lip as 29*e*'. The inner surface 29*e*' is below the shear line 18. It should also be noted that corresponding tumbler pin 32*e* is the highest tumbler pin in the lock assembly and the height of the lip must be correlated with the height of the tallest tumbler pin to ensure that the inner lip of the driver pin 26*e* and all the other driver pins be below the shear line 18. As discussed above, the thickness of the driver pin lip is correlated to the height of the tallest tumbler pin and the height of the shear line with the thickness of the lip being less than or equal to the difference.

Figure 4:
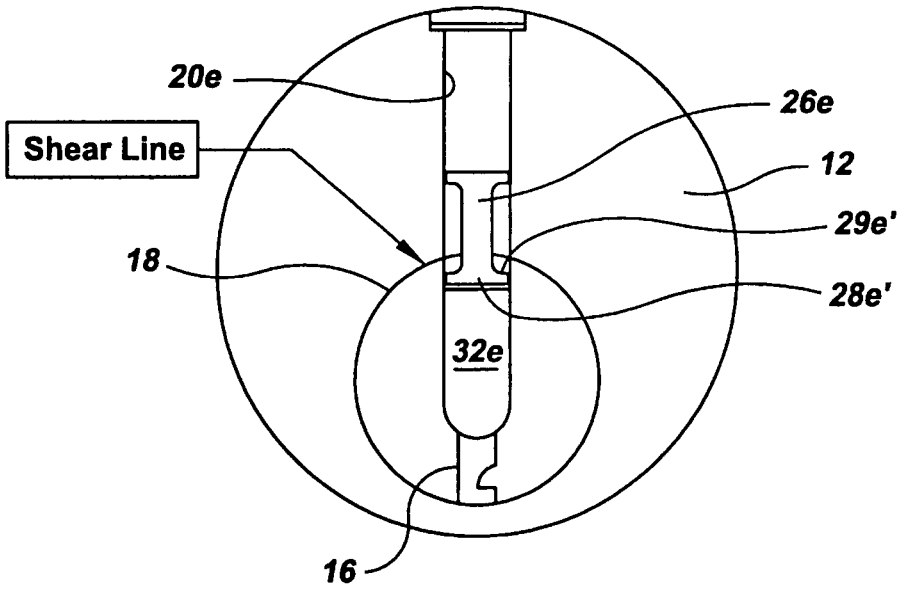
FIG. 4 is a cross-sectional view of FIG. 3 taken along lines 4-4 showing that the inner surface of the lip of the driver pin is below the shear line of the lock.

The purpose of the inner lip of the driver pin being below the shear line 18 is shown in FIG. 4 which is an end view of the lock showing driver pin 26*e* and tumbler pin 32*e*. Tumbler pin 32*e* is the tallest tumbler pin in the lock and this height in combination with the thickness of the lip 28*e*' of the driver pin 26*e* shows that the inner surface 29*e*' of the driver pin 26*e* is below the shear line 18.

Figure 5:
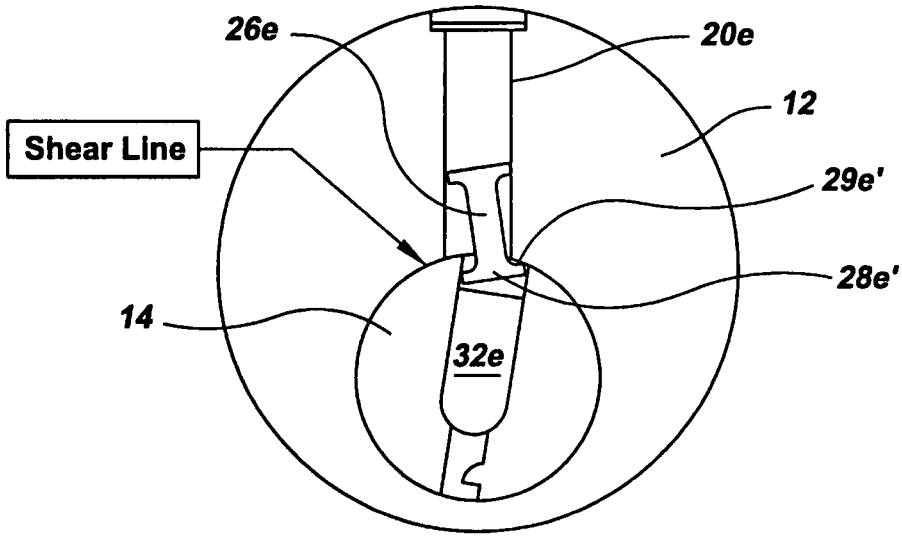
FIG. 5 is the same as FIG. 4 except that it shows how the lock of the invention prevents it from being bumped and opened because the inner lip of the driver pin is caught at the shear line and is prevented from being bumped into the cylinder bore by the cylinder inner surface.

Referring to FIG. 5, when bumping of the lock is attempted, the driver pin 26*e* will be disposed at an angle and the upper surface 29*e*' of the driver pin will be caught at the shear line between the cylinder 12 inner surface and plug 14 preventing the driver pin 26*e* from moving past the shear line into the cylinder bore 20*e*. Thus, the plug will not be able to be rotated and the bumping attempt will be a failure.

Figure 6:
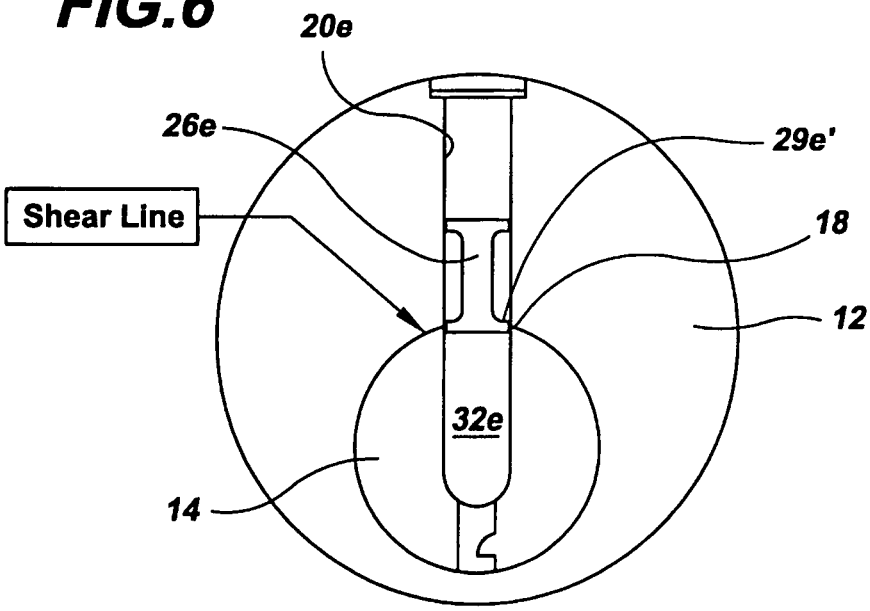
FIG. 6 is a view similar to FIG. 4 except that the lip of the driver pin is too thick and extends into the shear line of the lock preventing the lock from being turned so that on bumping the driver pin would be forced into the cylinder bore clearing the shear line and permitting rotation of the lock and opening the lock.

Referring now to FIG. 6, if the upper surface of the lip 29*e*' of the driver pin 26*e* is above the shear line 18, the plug 14 cannot rotate and the bumping operation will force the driver pin 26*e* straight upward into the cylinder bore 20*e* clearing the shear line 18 permitting rotation of the plug 14 and opening of the lock.

Figure 7:
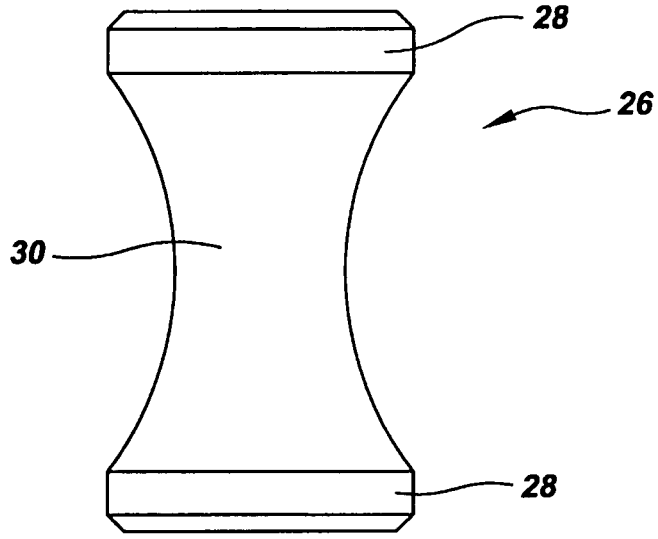
FIG. 7 is a driver pin of the invention which is of a symmetrical design and having a lip height so that the inner surface of the lip is always below the shear line of the lock as shown in FIG. 3.
Figure 8:
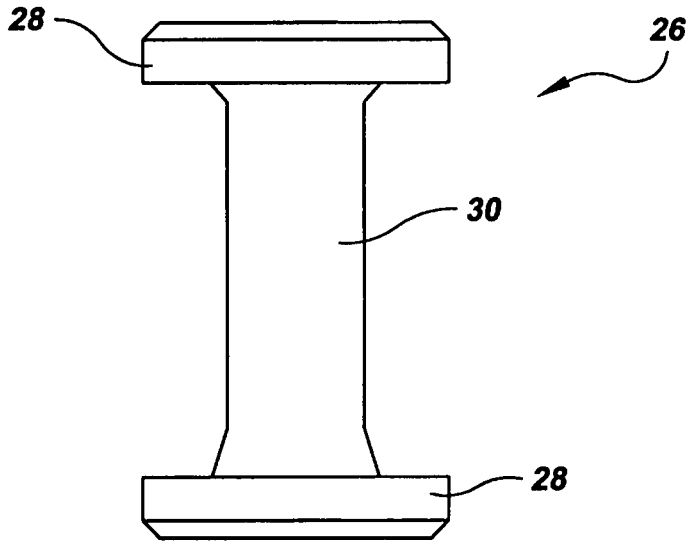
FIG. 8 is another driver pin design of symmetrical shape of the invention and also has a lip thickness so that the inner surface of the lip is always below the shear line of the lock as shown in FIG. 3.

FIGS. 7 and 8 show two embodiments of preferred driver pins 26 of the invention. As will be noted the pins are both symmetrical about a thinner shank 30 having the same lips 28 at each end. This is another important feature of the invention so that when the locks are being retrofitted, the driver pins 26 can be inserted in the cylinder bores in any direction. This makes the retrofitting easy and fool-proof for the installer.

For a particular commercial lock, the thickness of the lip has been found to be 0.020 inches or less based on a tallest tumbler stack height of 0.23 inch and shear line height of 0.25 inch. The plug has a diameter of 0.5 inch and the cylinder has a diameter of about 1 inch. It has been found that it is preferred to use a stronger material of construction to make the driver pin because of the thin lip and stainless steel, preferably 300 series, is preferred over the typical brass material. It is also preferred to correlate the diameter of the lip of the driver pin with the diameter of the bores so that the diameter of the lip is about 80% to 99%, e.g., 85% to 95%, of the diameter of the bore. The smaller diameter lip enhances the resistance of the lock to bumping by allowing lateral movement of the pin during bumping.

Thus, having described the invention, what is claimed is:

1. A pin and tumbler cylinder lock which is configured to prevent opening of the lock by bumping comprising:

a cylinder;

a plug rotably mounted in the cylinder and having a key slot and forming a shear line between the inner surface of the cylinder and outer surface of the plug, the cylinder and plug having a plurality of registering radial pin receiving bores which have straight non-chamfered sidewalls at the shear line;

spring pressed top driver pins mounted in the cylinder holes, each of the driver pins being about the same height; and tumbler pins mounted in the registered plug bores;

wherein each of the top driver pins has a smaller diameter intermediate section forming at least a lower lip having an inner surface and an outer surface where the outer surface of each top driver pin lip is in contact with the upper surface of the registered tumbler pin and the inner surface of each top driver pin lip is below the shear line and the thickness of the lip of the top driver pin is less than the shear line height minus the tallest tumbler pin stack height of the lock so that if the plug is rotated during bumping the driver pins will be disposed at an angle because of the smaller diameter intermediate section of the top driver pins and the driver pins will be caught at the shear line preventing rotation of the plug and opening of the lock by the bumping.

2. The pin and tumbler lock of claim 1 wherein the top driver pins are symmetrical.

3. The pin and tumbler lock of claim 1 wherein all or some of the top driver pins are made from stainless steel.

4. A method to retrofit existing tumbler and cylinder locks to enhance their resistance to bumping comprising the steps:

providing a pin and tumbler cylinder lock comprising:

a cylinder;

a plug rotably mounted in the cylinder and having a key slot and forming a shear line between the inner surface of the cylinder and outer surface of the plug, the cylinder, and plug having a plurality of registering radial pin receiving bores which bores have straight non-chamfered sidewalls at the shear line;

spring pressed top driver pins mounted in the cylinder bores; and tumbler pins mounted in the registered plug bores;

removing all of the driver pins in the existing lock; and replacing all of the top driver pins with a driver pin which has a smaller diameter intermediate section forming at least a lower lip having an inner surface and an outer surface where the outer surface of each top driver pin lip is in contact with the upper surface of the registered tumbler pin and the thickness of the lip of the top driver pin is less than the shear line height minus the tallest tumbler pin stack height of the lock so that the inner surface of each replaced top driver pin lower lip is below the shear line so that if the plug is rotated during bumping the driver pins will be disposed at an angle because of the smaller diameter intermediate section of the top driver pins and the driver pins will be caught at the shear line preventing rotation of the plug and opening of the lock by the bumping.

5. The method of claim 4 wherein the replaced top driver pins are symmetrical.

6. A retrofitted pin and tumbler lock made by the method of claim 5.

7. The method of claim 4 wherein all the replaced top driver pins are made from stainless steel.

8. A retrofitted pin and tumbler lock made by the method of claim 7.

9. The method of claim 4 wherein all the replaced top driver pins are symmetrical.

10. A retrofitted pin and tumbler lock made by the method of claim 9.

11. A retrofitted pin and tumbler lock made by the method of claim 4.

* * * * *